US007397335B2

(12) United States Patent
Kawarai

(10) Patent No.: US 7,397,335 B2
(45) Date of Patent: Jul. 8, 2008

(54) INDUCTANCE DEVICE

(75) Inventor: Mitsugu Kawarai, Tokyo (JP)

(73) Assignee: Sumida Corporation, Tokyo (JP)

( * ) Notice: Subject to any disclaimer, the term of this patent is extended or adjusted under 35 U.S.C. 154(b) by 43 days.

(21) Appl. No.: 11/092,614

(22) Filed: Mar. 30, 2005

(65) Prior Publication Data

US 2005/0218742 A1 Oct. 6, 2005

(30) Foreign Application Priority Data

Mar. 31, 2004 (JP) ..... 2004-108584

(51) Int. Cl.
*H01F 5/00* (2006.01)

(52) U.S. Cl. ..... 336/200

(58) Field of Classification Search ..... 336/200
See application file for complete search history.

(56) References Cited

U.S. PATENT DOCUMENTS 5,889,373 A * 3/1999 Fisher et al. ..... 315/307

FOREIGN PATENT DOCUMENTS

JP 57096513 A * 6/1982

JP 2001267129 * 3/2000

OTHER PUBLICATIONS

Hitoshi; "Multilayer Inductance Element"; Patent Abstracts of Japan, of JP 10-335144, Publication date of application, Dec. 18, 1998.

Keiji; "Chip Inductor and Manufacturing Method Thereof"; Patent Abstracts of Japan, of JP 2001-267129, Publication date of application, Sep. 28, 2001.

* cited by examiner

*Primary Examiner*—Elvin Enad
*Assistant Examiner*—Joselito Baisa
(74) *Attorney, Agent, or Firm*—Finnegan, Henderson, Farabow, Garrett & Dunner, L.L.P.

(57) ABSTRACT

The superimposition characteristics are improved in an inductance device provided with coils having sections with different numbers of windings. The inductance device includes a ring-shaped coil having n winding section 31 in which the number of windings is n and n+1, magnetic circuit materials mounted within and without the ring of aforementioned coil through which magnetic flux is passed to form a magnetic circuit, and a magnetic gap that blocks either the magnetic flux that was formed so as to surround aforementioned n winding section 31 or the magnetic flux that was formed so as to surround aforementioned n+1 winding section 32.

9 Claims, 25 Drawing Sheets

(d 1)

(e 1)

(f 1)

(g 1)

(h 1)

(f 1')

(a 2)

(b 2)

(c 2)

(d 2)

(e 2)

(f 2)

(g 2)

(h 2)

(f 2')

(a 3)

(b 3)

(c 3)

(d 3)

(e 3)

(f 3)

(g 3)

(h 3)

(i 3)

(j 3)

(k 3)

(a 4)

(b 4)

(c 4)

(d 4)

(e 4)

(f 4)

(g 4)

(h 4)

(i 4)

(j 4)

(k 4)

INDUCTANCE DEVICE

TECHNICAL FIELD OF INVENTION

The present invention concerns an inductance device having a ring-shaped coil.

BACKGROUND TECHNOLOGY

A multilayered type of inductance device has the shape of a block-shaped parallelepiped, for example, with electrodes mounted on two opposing surfaces of the parallelepiped and terminal patterns extended to a coil within the block that are connected to aforementioned electrodes.

For this reason, aforementioned extended sections in a ring-shaped coil have a structure in which the number of windings (number of turns) is one turn greater than in other ring sections, as shown in FIG. 4, for example.

When using an inductance device with such a structure, the magnetic field that is generated develops imbalance commensurate with the number of turns, and this is known to lower the direct-current superimposition characteristics.

The patent literature associated with the present invention that can be cited includes the gazette of Japanese Kokai Publication 2001-267129 as the first and the gazette of Japanese Kokai Publication Hei-10-335144 as the second.

Problems Solved by the Invention

The purpose of the present invention is to provide an inductance device with good direct-current superimposition characteristics in which the imbalance in the magnetic field that is generated is corrected by the provision of a section with a large number of turns and a section with a low number of turns to solve aforementioned problems.

Means of Solving the Problems

The inductance device pursuant to the present invention is provided with a ring-shaped coil having an n winding section in which the number of windings is n and an n+1 winding section in which the number of windings is n+1, magnetic circuit material mounted within and without the ring of aforementioned coil through which magnetic flux is passed to form a magnetic circuit, and a magnetic gap that blocks either the magnetic flux that was formed so as to surround aforementioned n winding section or the magnetic flux that was formed so as to surround aforementioned n+1 winding section.

The inductance device pursuant to the present invention is provided with a ring-shaped coil having an n winding section in which the number of windings is n and an n+1 winding section in which the number of windings is n+1, magnetic circuit material mounted within and without the ring of aforementioned coil through which magnetic flux is passed to form a magnetic circuit, a first magnetic gap that blocks either the magnetic flux that was formed so as to surround aforementioned n winding section or the magnetic flux that was formed so as to surround aforementioned n+1 winding section, and a second magnetic gap that is narrower than the first magnetic gap that blocks aforementioned magnetic flux in a direction orthogonal to the axial direction of aforementioned ring.

The inductance device pursuant to the present invention is a multilayered type of inductance device that is structured with a ring-shaped coil having an n winding section in which the number of windings is n and an n+1 winding section in which the number of windings is n+1, and with a soft magnetic ceramic member that is embedded within aforementioned coil, both of which are layered within the same device. It is provided with aforementioned soft magnetic ceramic member that is mounted within and without the ring of aforementioned coil to comprise magnetic circuit material through which magnetic flux is passed to form a magnetic circuit, and a magnetic gap that is mounted that blocks either the magnetic flux that was formed so as to surround aforementioned n winding section or the magnetic flux that was formed so as to surround aforementioned n+1 winding section.

The inductance device pursuant to the present invention is a multilayered type of inductance device that is structured with a ring-shaped coil having an n winding section in which the number of windings is n and an n+1 winding section in which the number of windings is n+1, and with a soft magnetic ceramic member that is embedded within aforementioned coil, both of which are layered within the same device. It is provided with aforementioned soft magnetic ceramic member that is mounted within and without the ring of aforementioned coil to comprise magnetic circuit material through which magnetic flux is passed to form a magnetic circuit, a first magnetic gap that blocks either the magnetic flux that was formed so as to surround aforementioned n winding section or the magnetic flux that was formed so as to surround aforementioned n+1 winding section, and a second magnetic gap that is narrower than the first magnetic gap that blocks aforementioned magnetic flux in a direction orthogonal to the axial direction of aforementioned ring.

The inductance device pursuant to the present invention is structured so that the first and second magnetic gaps that block aforementioned magnetic flux are made of nonmagnetic ceramic.

A magnetic gap that blocks the magnetic flux is formed since part of either aforementioned n winding section or aforementioned n+1 winding section is exposed outside of the block formed from magnetic circuit material in the inductance device pursuant to the present invention.

The inductance device pursuant to the present invention is characterized by coating aforementioned exposed section with insulating resin.

The number n in aforementioned n winding section and aforementioned n+l winding section in the inductance device pursuant to the present invention is not more than 4.

Effects of Invention

Improvement in the direction of balancing the imbalance in the magnetic flux that was formed is possible since either the magnetic flux that was formed so as to surround the n winding section or the magnetic flux that was formed so as to surround the n+1 winding section is blocked in the inductance device having aforementioned structure, and the direct-current superimposition characteristics can be improved.

BEST MODE FOR IMPLEMENTING INVENTION

The objective of improving the direct-current superimposition characteristics by correcting the imbalance in the magnetic field that is generated in the section with a large number of turns and the section with a low number of turns is attained by a comparatively simple structure in which a magnetic gap that blocks the magnetic flux is mounted. Working examples of the inductance device pursuant to the present invention are explained with reference to the appended figures below. Identical structures in each diagram are given the same notation to avoid duplicate explanation.

WORKING EXAMPLE 1

Figure 1:
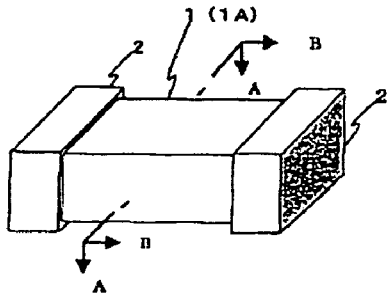
FIG. 1 is a general view of an inductance device in each working example of the present invention.
Figure 2:
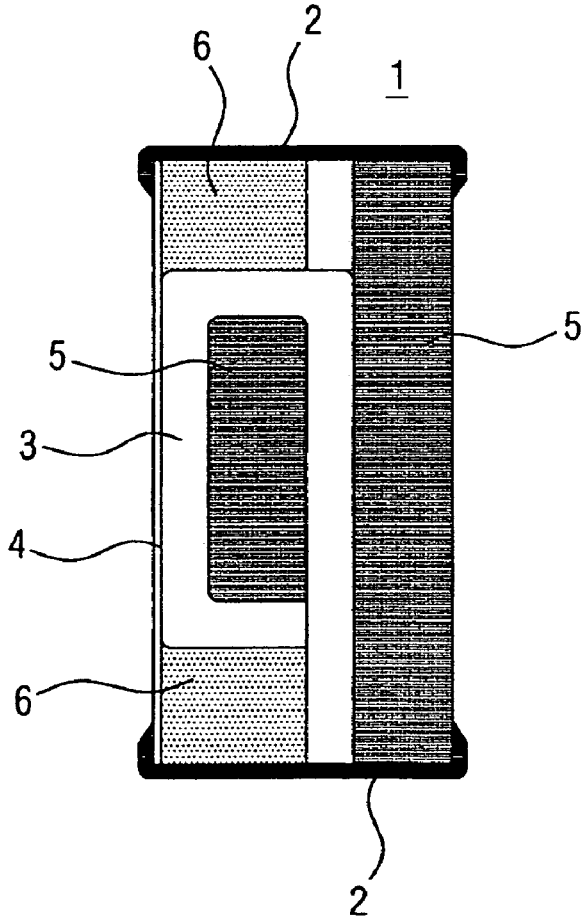
FIG. 2 is an A-A profile of the inductance device in FIG. 1 in the first working example.
Figure 3:
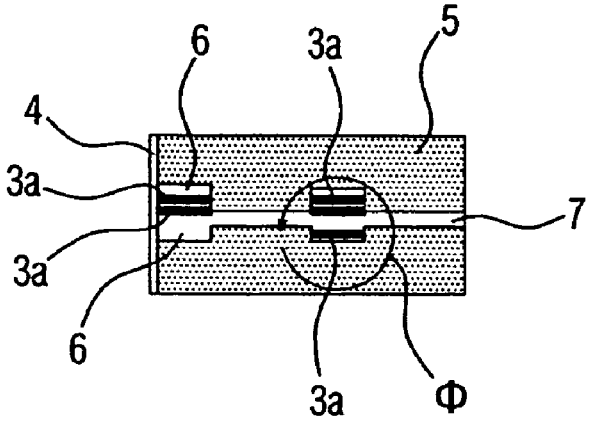
FIG. 3 is a B-B profile of the inductance device in FIG. 1 in the first working example.
Figure 4:
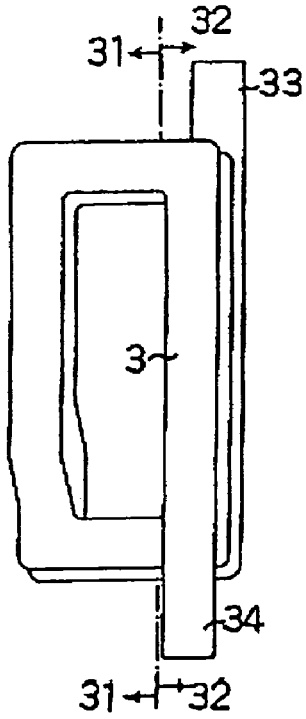
FIG. 4 is an oblique view showing the coil used in the first and second working examples of the present invention.

FIG. 1 shows a general view of inductance device 1. FIG. 2 is an A-A profile. FIG. 3 is a B-B profile. Electrodes 2 are mounted on a pair of surfaces that face inductance device 1. FIG. 4 shows isolated coil 3. In short, it has a square ring shape with n winding section 31 in which the number of windings is n and n+1 winding section 32 in which the number of windings is n+1.

Winding origin 33 and winding terminus 34 of coil 3 extend from the ring-shaped section to the sides of electrodes 2, 2 where they connect to electrode 2. n winding section 31 in coil 3 contains a section parallel to n+1 winding section 32. The conductor comprising coil 3 with an exposed side is formed on the side wall of inductance device 1, and insulating resin 4 is applied to this exposed section.

The ring center in coil 3 and the exterior of n+1 winding section 32 are formed from magnetic material 5 which is magnetic circuit material. Nonmagnetic material 6 is mounted so that conductor pattern 3*a* of the coil is interposed. In particular, nonmagnetic material 6 is mounted above and below n winding section 31 so as to be thicker than the separation between conductor patterns 3*a*, 3*a*.

Second magnetic gap 7 comprising nonmagnetic material that is narrower (thinner) than the first magnetic gap made of nonmagnetic material 6 that is mounted above and below n winding section 31 is mounted between the bottom-most conductor pattern 3*a* in n+1 winding section 32 and conductor pattern 3*a* thereabove, viewed from the bottom of conductor pattern 3*a* of n winding section 31.

Figure 5:
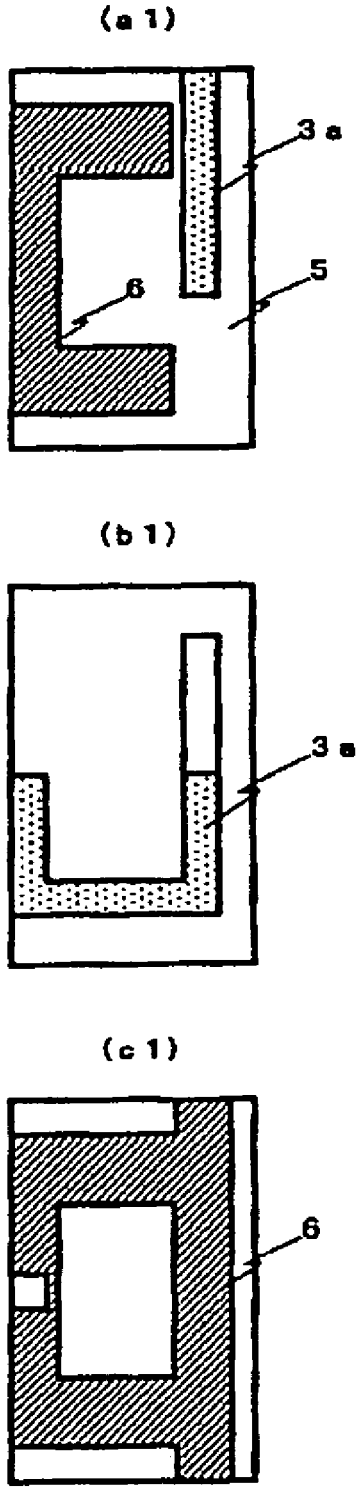
FIG. 5 is a diagram showing the production steps of the inductance device pursuant to the first working example of the present invention.
Figure 6:
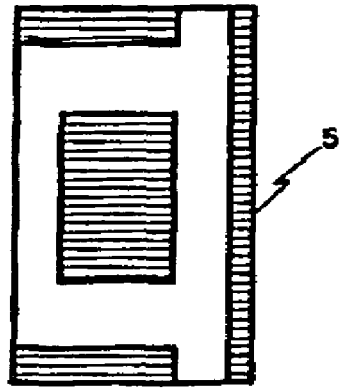
FIG. 6 is a diagram showing the production steps of the inductance device pursuant to the first working example of the present invention.
Figure 6:
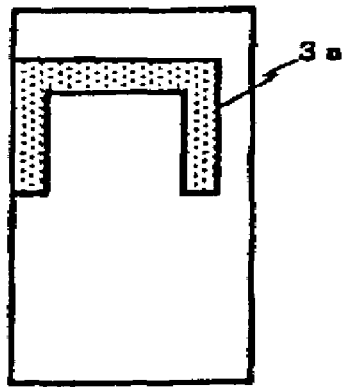
Figure 6:
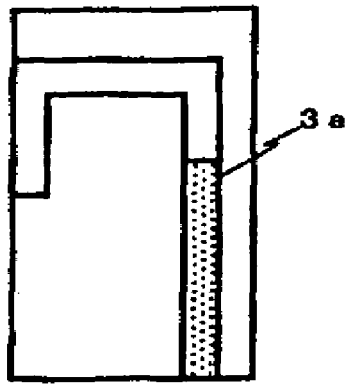
Figure 7:
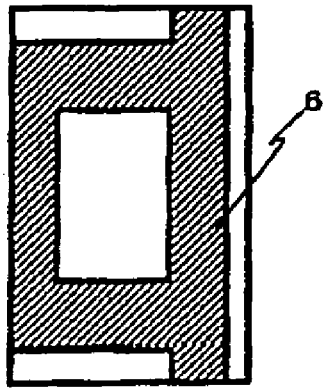
FIG. 7 is a diagram showing the production steps of the inductance device pursuant to the first working example of the present invention.
Figure 7:
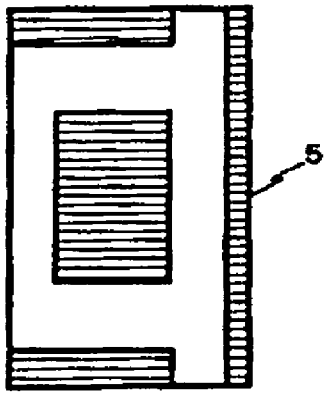
Figure 7:
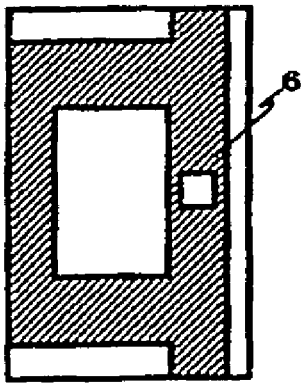

Inductance device 1 is constructed through the procedures shown in FIGS. 5 to 7. A magnetic layer is formed by superimposing a plurality of magnetic sheets, and nonmagnetic material 6 is thickly applied at the position where n winding section 31, which is over said magnetic layer, is disposed. Magnetic material 5 is mounted in the remaining regions so as to form a flat surface. Bar-shaped conductor pattern 3*a*, which is formed through printing with a mask, extends in linear shape from one edge on which is mounted electrode 2 and terminates ⅔ of the distance to the other end on this flat surface, as shown in FIG. 5 (*a*1). Next, conductor pattern 3*a* with a three-sided box (shape) corresponding to ½ turn of coil 3 is formed by mask printing (FIG. 5(*b*1)).

Next, nonmagnetic material 6 that covers the region corresponding to one turn of coil 3 and the region that covers the terminus which extends to the electrode (region corresponding to 1.5 turns) is printed, as shown in (FIG. 5(*c*1)). A window is mounted in the section of nonmagnetic material 6 corresponding to the terminus of conductor pattern 3*a* shown in FIG. 5(*b*1), and nonmagnetic material 6 is not applied. The exterior of the final straight part in conductor pattern 3*a* having a three-sided box (shape) as shown in FIG. 5(*b*1) remains exposed in this state.

Next, as shown in FIG. 6(*d*1), magnetic material 5 is printed in regions excluding the region of nonmagnetic material 6 in FIG. 5(*c*1). Then, conductor pattern 3*a* is formed through printing by using a mask with an aperture at the region corresponding to ½ turn of the wire of coil 3 so as to match FIG. 5(*b*1), as shown in FIG. 6(*e*1). Bar-shaped conductor pattern 3*a*, which is formed through printing with a mask, extends in linear shape from the terminus of conductor pattern 3*a* in FIG. 6(*e*1) to the other end, as shown in FIG. 6(*f*1).

Next, nonmagnetic material 6 that covers the region corresponding to one turn of coil 7 and the region that covers the terminus which extends to the electrode (region corresponding to 1.5 turns) is printed, as shown in FIG. 7(*g*1). Next, as shown in FIG. 7(*h*1), magnetic material 5 is printed in regions excluding the region of nonmagnetic material 6 in FIG. 7(*g*1). An inductance device for 1.5 turns worth is completed in aforementioned manner.

To construct an inductance device for 1.5 turns worth+N (N is an integer) turns worth, nonmagnetic material 6 would be printed so as to cover the region corresponding to one turn of coil 3 and the region that covers the terminus which extends to the electrode (region corresponding to 1.5 turns), as shown in FIG. 7(*f*1'), instead of using the mask shown in FIG. 6(*f*1). In the region of nonmagnetic material 6, a window is mounted in the section of nonmagnetic material 6 corresponding to the terminus of conductor pattern 3*a* shown in FIG. 6(*e*1), and nonmagnetic material 6 is not applied. The sequence of procedures returns from the step shown in FIG. 7(*f*1') to the step shown in FIG. 5(*b*11), and the steps shown in FIG. 5(*b*), FIG. 5(*c*1), FIG. 6( When second magnetic gap 7 is mounted, it has the same size as that of the surface of inductance device 1. A sheet of nonmagnetic material having the same window as the window mounted in nonmagnetic material 6 of FIG. 7 (*f*1') is used. Second magnetic gap 7 can be mounted by using this sheet of nonmagnetic material instead of nonmagnetic material 6 from FIG. 7 (*f*1').

Since the side of the conductor comprising coil 3 is exposed in such a multilayered state, insulating resin 4 is applied to this exposed section. As noted above, a paste comprising conducting powder primarily of silver with synthetic resin binder is used as conductor pattern 3*a*, a paste comprising ferrite soft magnetic powder (for example, Ni—Cu—Zn ferrite) with synthetic resin binder is used as magnetic material of the magnetic layer comprising magnetic material 5, and a paste comprising nonmagnetic ceramic powder (for example, Ni—Cu ferrite or glass ceramic) with synthetic resin binder is used as nonmagnetic material 6. A magnetic layer comprising magnetic material 5 that is laid on top of this multilayered construct is oriented in place, press-laminated and concurrently sintered to complete construction.

Nonmagnetic material 6 is mounted above and below n winding section 31 so as to be thicker than the separation between conductor patterns 3*a*, 3*a*, the conductor comprising coil 3 with an exposed side has insulating resin 4 applied to this exposed section that acts as a magnetic gap in the inductance device having aforementioned structure, and as clarified in FIG. 3, no magnetic flux is created so as to surround n winding section 31. In short, a magnetic gap is mounted that blocks a magnetic flux from surrounding n winding section 31. On the other hand, magnetic flux Φ is formed so as to surround n+1 winding section 32 (FIG. 3). This is because a magnetic gap that blocks magnetic flux Φ is not mounted in the magnetic circuit of magnetic flux Φ.

Figure 26:
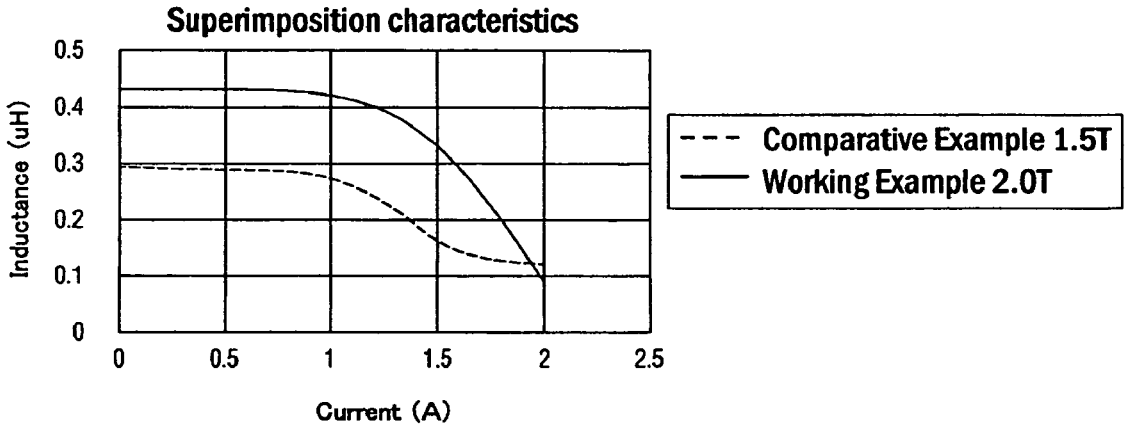
FIG. 26 is a diagram showing the direct-current superimposition characteristics in this working example and in a comparative example.
Figure 27:
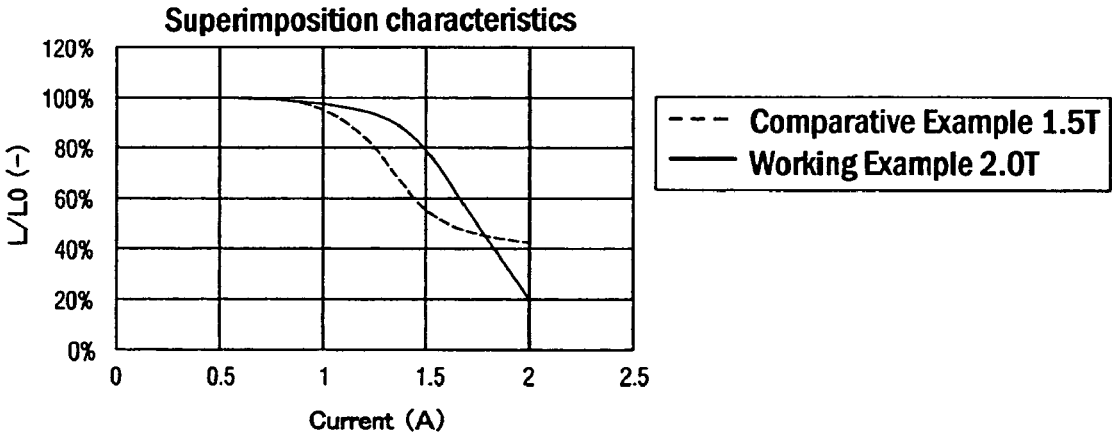
FIG. 27 is a diagram showing the ratios of the direct-current superimposition characteristics in this working example and in a comparative example.

The result of preventing the formation of magnetic flux surrounding only n winding section 31 in aforementioned structure is that the characteristics become equivalent to those of the inductance device having only n+1 winding section 32, thereby correcting the imbalance in the number of windings and permitting improvement of the direct-current superimposition characteristics. FIG. 26 shows the direct-current superimposition characteristics in this working example and in a comparative example. FIG. 27 shows the ratios of the direct-current superimposition characteristics in this working example and in a comparative example. These diagrams clearly indicate that the direct-current superimposition characteristics can be improved in this working example in which magnetic flux surrounds only the portion of two turns (two windings). A structure having a section with two turns (two windings) and a section with one turn (one winding) so as to have 1.5 turns overall is shown to have poor direct-current superimposition characteristics and a low inductance value. Further improvement in the direct-current superimposition characteristics by mounting second magnetic gap 7 was attempted in a working example.

WORKING EXAMPLE 2

Figure 8:
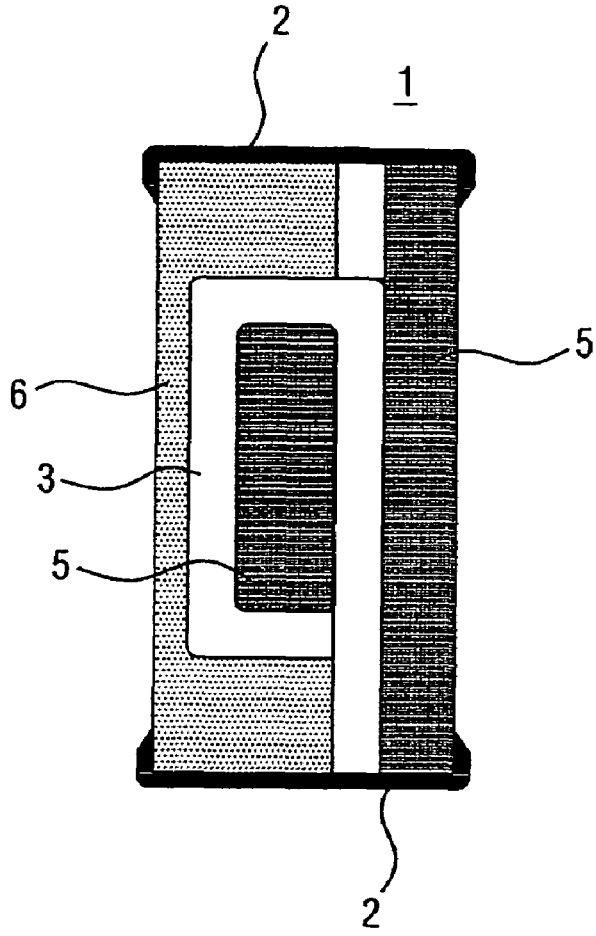
FIG. 8 is an A-A profile of the inductance device in FIG. 1 in the second working example.
Figure 9:
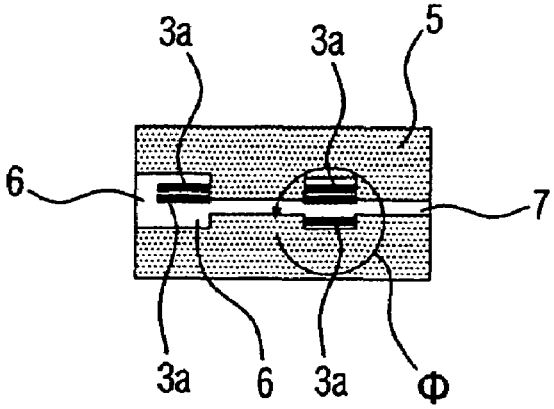
FIG. 9 is a B-B profile of the inductance device in FIG. 1 in the second working example.

A second working example is explained below. FIG. 8 is an A-A profile of inductance device 1 in this working example while FIG. 9 is a B-B profile. In the first working example, the conductor comprising coil 3 with an exposed side is formed, and insulating resin 4 is applied to this exposed section, but in this working example, nonmagnetic material 6 is disposed on the section covered by aforementioned insulating resin 4, and the top, bottom and outside of n winding section 31 are surrounded by nonmagnetic material 6 so as to form a magnetic gap that blocks the magnetic flux from forming so as to surround n winding section 31.

Figure 10:
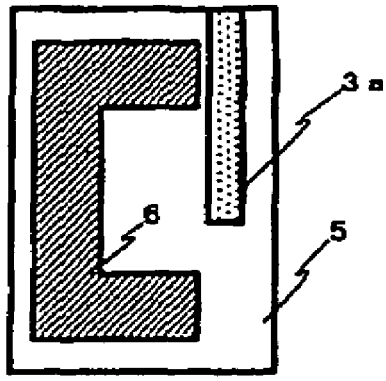
FIG. 10 is a diagram showing the production steps of the inductance device pursuant to the second working example of the present invention.
Figure 10:
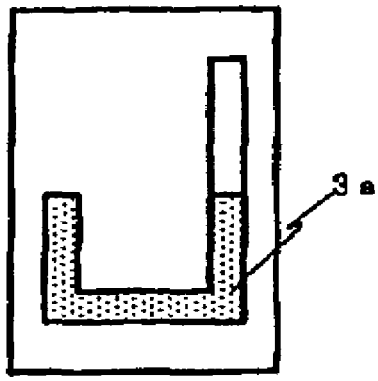
Figure 10:
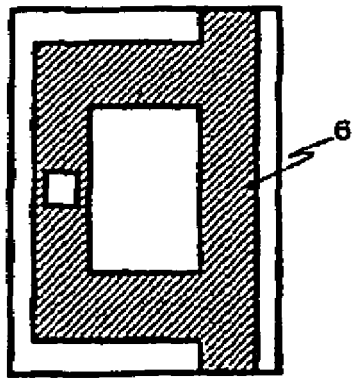
Figure 11:
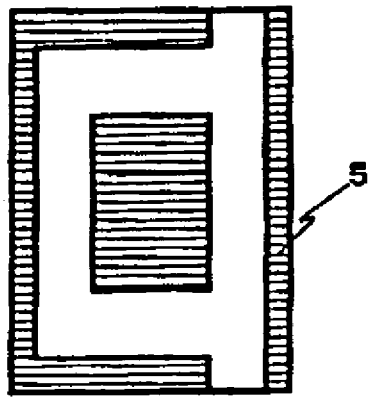
FIG. 11 is a diagram showing the production steps of the inductance device pursuant to the second working example of the present invention.
Figure 11:
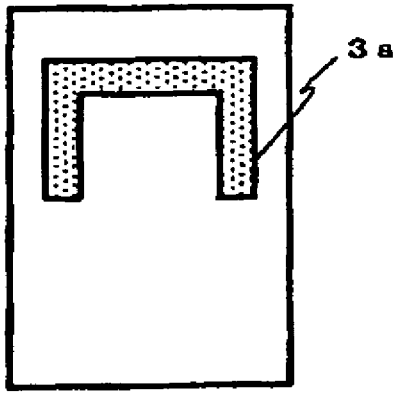
Figure 11:
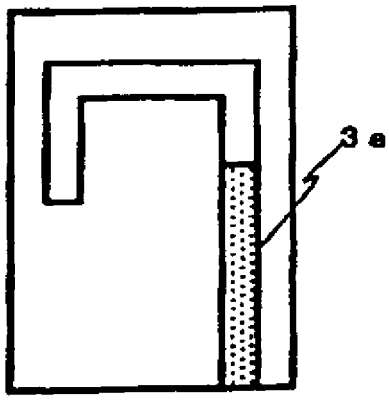
Figure 12:
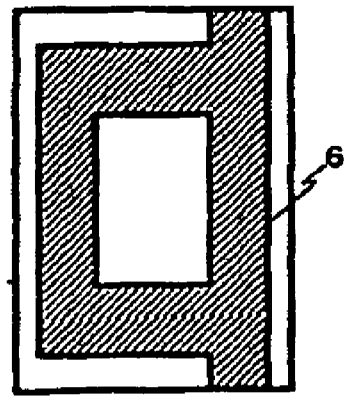
FIG. 12 is a diagram showing the production steps of the inductance device pursuant to the second working example of the present invention.
Figure 12:
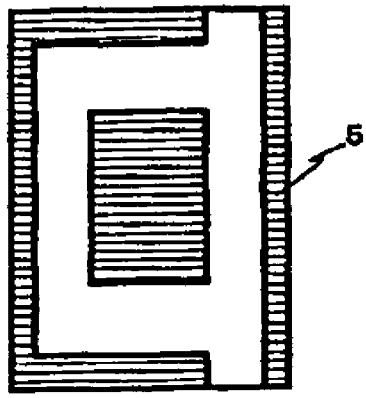
Figure 12:
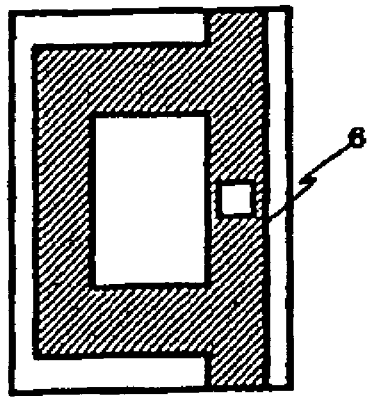

This inductance device 1 is constructed through the procedures shown in FIGS. 10 to 12. The construction procedures of this inductance device 1 are basically identical with the procedures explained in FIGS. 5 to 7. However, the difference is that nonmagnetic material 6 is disposed at the section covered by insulating resin 4 in aforementioned first working example. The section upon which is mounted nonmagnetic material 6 as explained above acts as a magnetic gap in this second working example as well, and a magnetic flux is not formed so as to surround n winding section 31, as shown in FIG. 9. On the other hand, magnetic flux Φ is formed so as to surround n+1 winding section 32 (FIG. 3). This is because a magnetic gap that blocks magnetic flux Φ is not mounted in the magnetic circuit of magnetic flux Φ.

WORKING EXAMPLE 3

Figure 13:
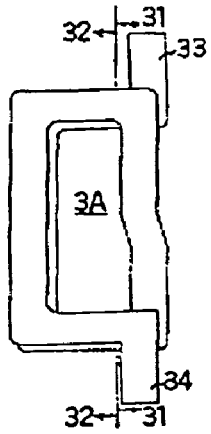
FIG. 13 is an oblique view showing the coil used in the third and fourth working examples of the present invention.

Coil 3A as shown in FIG. 13 is used in the inductance device 1A (FIG. 1) pursuant to the third working example. This coil 3A is a square ring shape having n winding section 31 in which the number of windings is n and n+1 winding section 32 in which the number of windings is n+1. Winding origin 33 and winding terminus 34 of coil 3A extend from the ring-shaped section to the sides of electrodes 2, 2 where they connect to electrode 2.

Figure 14:
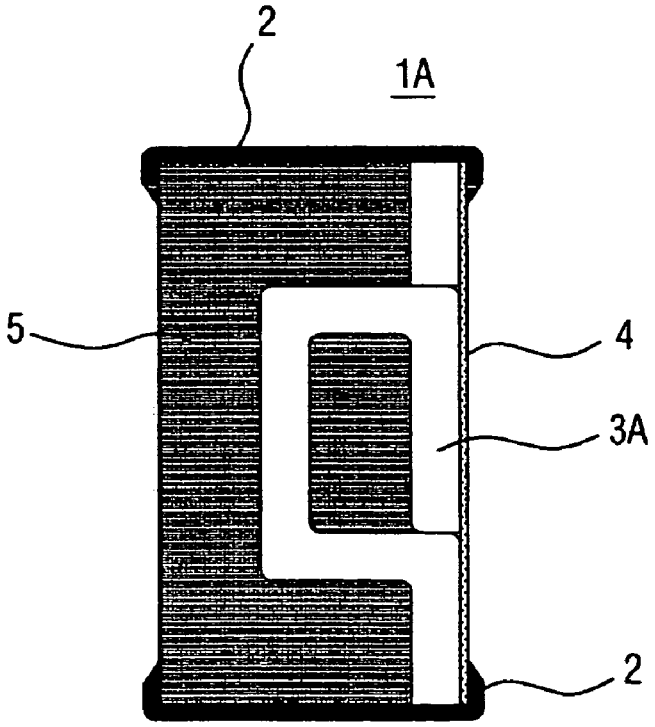
FIG. 14 is an A-A profile of the inductance device in FIG. 1 in the third working example.
Figure 15:
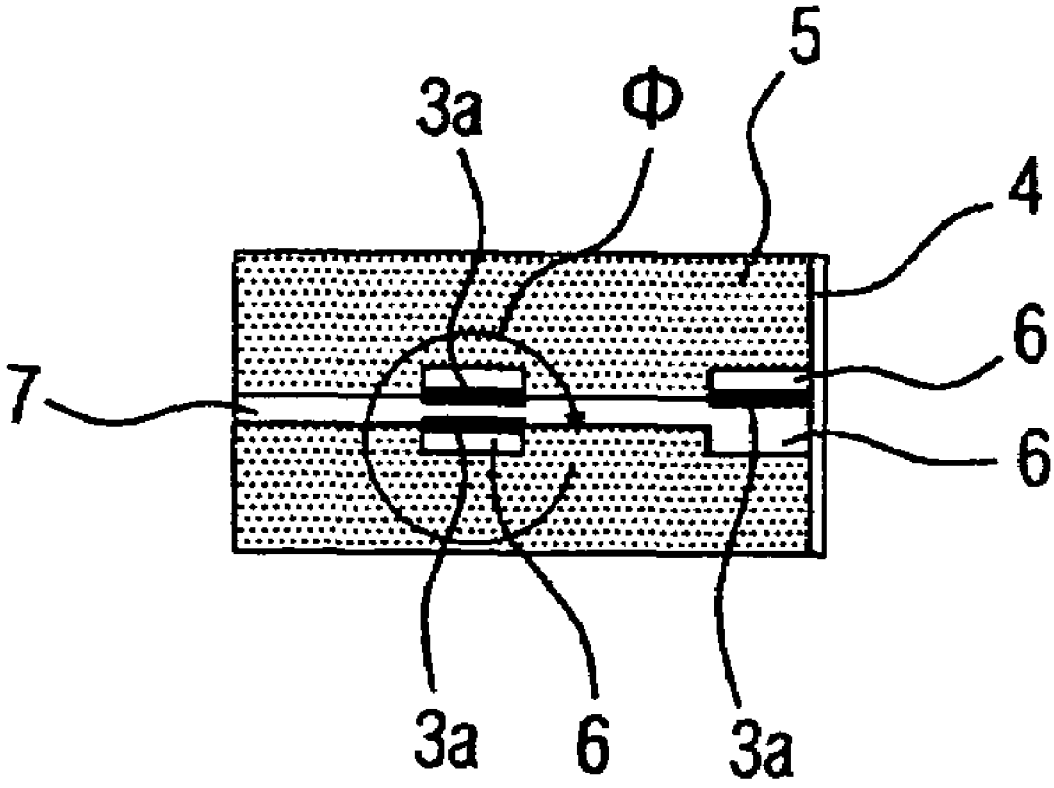
FIG. 15 is a B-B profile of the inductance device in FIG. 1 in the third working example.

FIG. 14 is an A-A profile of inductance device 1A in the third working example while FIG. 15 is a B-B profile. A conductor comprising coil 3A with an exposed side is formed on the side wall of inductance device 1A in n winding section 31 in coil 3A, and insulating resin 4 is applied to this exposed section.

The ring center in coil 3A and the exterior of n+1 winding section 32 are formed from magnetic material 5 which is magnetic circuit material. Nonmagnetic material 6 is mounted so that conductor pattern 3*a* of the coil is interposed. In particular, nonmagnetic material 6 is mounted above and below n winding section 31 so as to be thicker than the separation between conductor patterns 3*a*, 3*a* in n+1 winding section 32.

Second magnetic gap 7 comprising nonmagnetic material that is narrower (thinner) than nonmagnetic material 6 that is mounted above and below n winding section 31 is mounted between the bottom-most conductor pattern 3*a* in n+1 winding section 32 and conductor pattern 3*a* thereabove, viewed from the bottom of conductor pattern 3*a* of n winding section 31.

Figure 16:
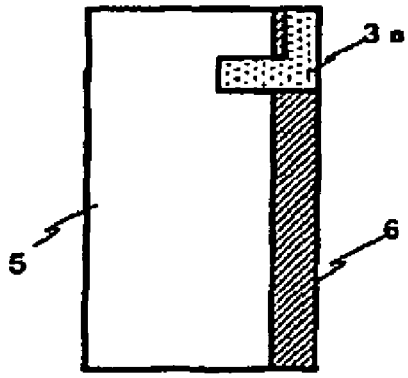
FIG. 16 is a diagram showing the production steps of the inductance device pursuant to the third working example of the present invention.
Figure 16:
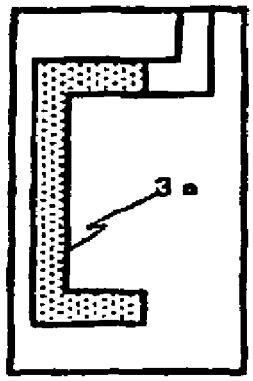
Figure 16:
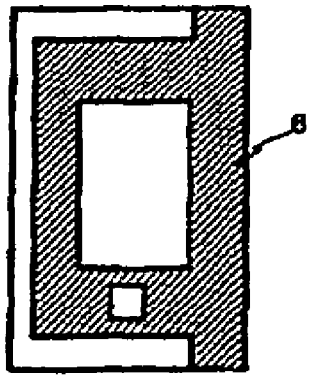

Inductance device 1 is constructed through the procedures shown in FIGS. 16 to 19. A magnetic layer is formed by superimposing a plurality of magnetic sheets, and nonmagnetic material 6 is thickly applied at the position where n winding section 31, which is over said magnetic layer, is disposed. Magnetic material 5 is mounted in the remaining regions so as to form a flat surface. Bar-shaped conductor pattern 3*a*, which is formed through printing with a mask on this flat surface, as shown in FIG. 16(*a*3), is bent, extends in linear shape from one edge on which is mounted electrode 2, and terminates at a distance equal to ½ of the side that is bent at a right angle. Next, conductor pattern 3*a* with a three-sided box (shape) corresponding to ½ turn of coil 3A is formed by mask printing (FIG. 16(*b*3)).

Next, nonmagnetic material 6 that covers the region corresponding to one turn of coil 3A and the region that covers the terminus which extends to the electrode (remaining region of coil 3A) is printed, as shown in FIG. 16(*c*3). A window is mounted in the section of nonmagnetic material 6 corresponding to the terminus of conductor pattern 3*a* shown in FIG. 16(*b*3), and nonmagnetic material 6 is not applied. The exterior of the final straight part in conductor pattern 3*a* having a three-sided box (shape) as shown in FIG. 16(*b*3) remains exposed in this state.

Figure 17:
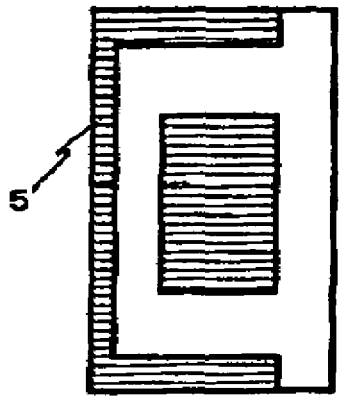
FIG. 17 is a diagram showing the production steps of the inductance device pursuant to the third working example of the present invention.
Figure 17:
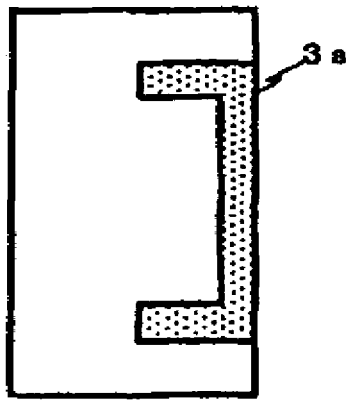
Figure 17:
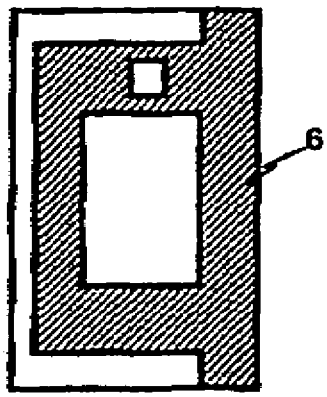

Next, as shown in FIG. 17(*d*3), magnetic material 5 is printed in regions excluding the region of nonmagnetic material 6 in FIG. 16(*c*3). Then, conductor pattern 3*a* is formed through printing by using a mask with an aperture at the region corresponding to ½ turn of the wire of coil 3A so as to match FIG. 16(*b*3), as shown in FIG. 17(*e*3).

Next, nonmagnetic material 6 that covers the region corresponding to one turn of coil 3 and the region that covers the terminus which extends to the electrode (remaining region of coil) is printed, as shown in FIG. 17(*f*3). A window is mounted in the section of nonmagnetic material 6 corresponding to the terminus of conductor pattern 3*a* shown in FIG. 17(*e*3), and nonmagnetic material 6 is not applied.

Figure 18:
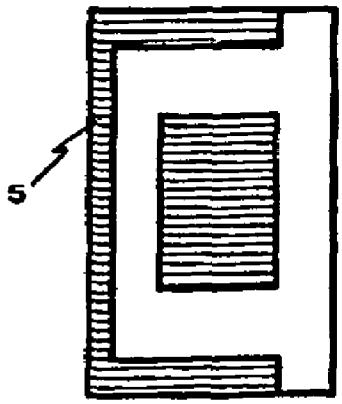
FIG. 18 is a diagram showing the production steps of the inductance device pursuant to the third working example of the present invention.
Figure 18:
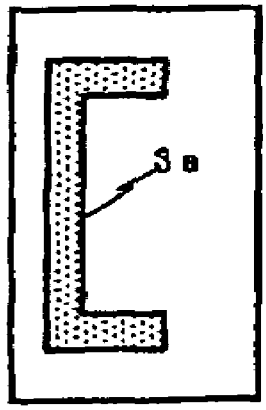
Figure 18:
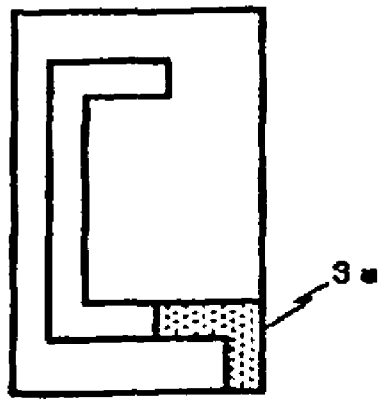

Next, as shown in FIG. 18(*g*3), magnetic material 5 is printed in regions excluding the region of nonmagnetic material 6 in FIG. 17(*f*3). Then, conductor pattern 3*a* is formed through printing by using a mask with an aperture at the region corresponding to ½ turn of the wire of coil 3A so as to match FIG. 17(*e*3), as shown in FIG. 18(*h*3). When the number of windings is increased, the sequence of procedures returns from the step shown in aforementioned FIG. 18(*h*3) to the step shown in FIG. 16(*c*3), and the steps shown in FIG. 16(*d*3), FIG. 16(*c*3), FIG. 17(*f*3), FIG. 18(*g*3), FIG. 18(*h*3) are repeated.

Figure 19:
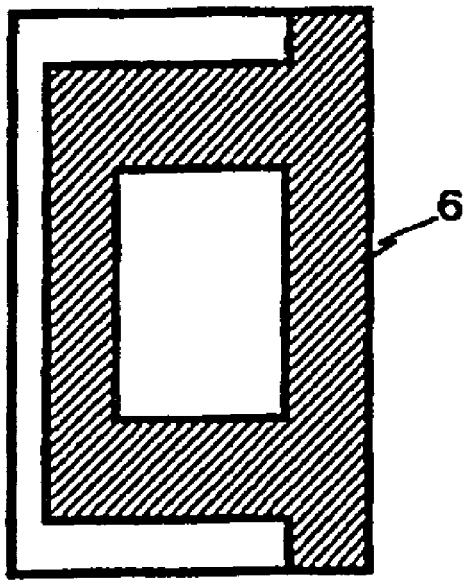
FIG. 19 is a diagram showing the production steps of the inductance device pursuant to the third working example of the present invention.
Figure 19:
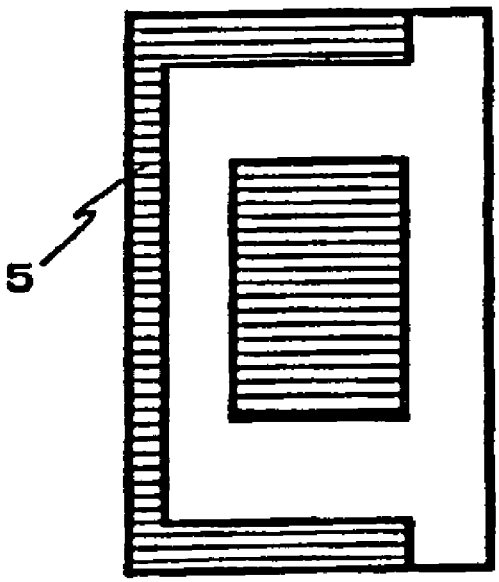

When a predetermined number of windings is reached, the procedure advances from FIG. 18(*h*3) to FIG. 18(*i*3), and a key-shaped conductor pattern 3*a* that extends to electrode 2 is printed using a mask. Next, nonmagnetic material 6 that covers the region corresponding to one turn of coil 3A and the region that covers the terminus which extends to the electrode (remaining region of coil 3A) is printed, as shown in FIG. 19(*j*3). Next, as shown in FIG. 19(*k*3), magnetic material 5 is printed in regions excluding the region of nonmagnetic material 6 in FIG. 19(*j*3). Thus, a 1.5-turn inductance device 1A is completed in aforementioned manner.

When second magnetic gap 7 is mounted, it has the same size as that of the surface of inductance device 1. A sheet of nonmagnetic material having the same window as the window mounted in nonmagnetic material 6 of FIG. 16(*c*3) is used. Second magnetic gap 7 can be mounted by using this sheet of nonmagnetic material instead of nonmagnetic material 6 from FIG. 16(*c*3).

Since the side of the conductor comprising coil 3A is exposed in such a multilayered state, insulating resin 4 is applied to this exposed section. As noted above, a paste comprising conducting powder primarily of silver with synthetic resin binder is used as conductor pattern 3*a*, a paste comprising ferrite soft magnetic powder (for example, Ni—Cu—Zn ferrite) with synthetic resin binder is used as magnetic material of the magnetic layer comprising magnetic material 5, and a paste comprising nonmagnetic ceramic powder (for example, Ni—Cu ferrite or glass ceramic) with synthetic resin binder is used as nonmagnetic material 6. A magnetic layer comprising magnetic material 5 that is laid on top of this multilayered construct is oriented in place, press-laminated and concurrently sintered to complete construction.

Nonmagnetic material 6 is mounted above and below n winding section 31 so as to be thicker than the separation between conductor patterns 3*a*, 3*a*, the conductor comprising coil 3 with an exposed side has insulating resin 4 applied to this exposed section that acts as a magnetic gap in the inductance device having aforementioned structure, and as clarified in FIG. 15, no magnetic flux is created so as to surround n winding section 31. In short, a magnetic gap is mounted that blocks a magnetic flux from surrounding n winding section 31. On the other hand, magnetic flux Φ is formed so as to surround n+1 winding section 32 (FIG. 15). This is because a magnetic gap that blocks magnetic flux Φ is not mounted in the magnetic circuit of magnetic flux Φ.

The result of preventing the formation of magnetic flux surrounding only n winding section 31 in aforementioned structure is that the characteristics become equivalent to those of the inductance device having only n+1 winding section 32, thereby correcting the imbalance in the number of windings and permitting improvement of the direct-current superimposition characteristics. FIG. 26 shows the direct-current superimposition characteristics in this working example and in a comparative example. FIG. 27 shows the ratios of the direct-current superimposition characteristics in this working example and in a comparative example. These diagrams clearly indicate that the direct-current superimposition characteristics can be improved in this working example in which magnetic flux surrounds only the portion of two turns (two windings). A structure having a section with two turns (two windings) and a section with one turn (one winding) so as to have 1.5 turns overall is shown to have poor direct-current superimposition characteristics and a low inductance value. Further improvement in the direct-current superimposition characteristics by mounting second magnetic gap 7 was attempted in a working example.

WORKING EXAMPLE 4

Figure 20:
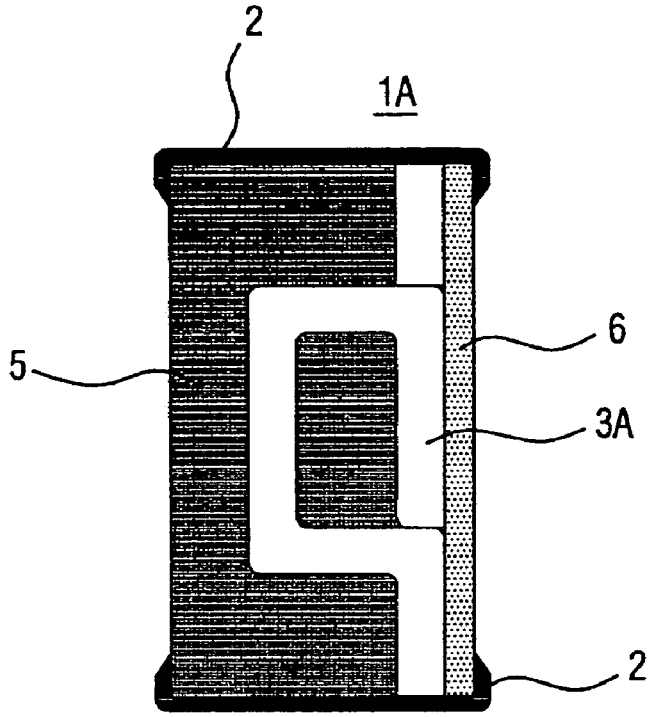
FIG. 20 is an A-A profile of the inductance device in FIG. 1 in the fourth working example.
Figure 21:
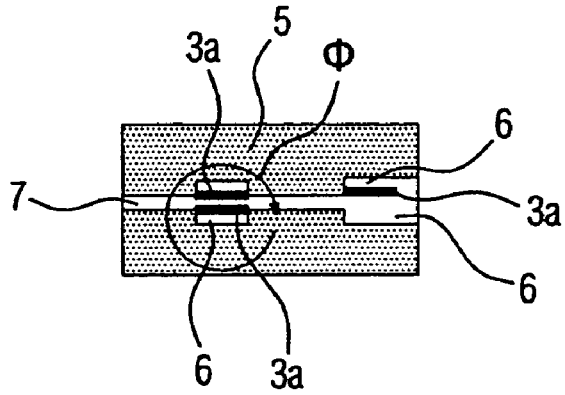
FIG. 21 is a B-B profile of the inductance device in FIG. 1 in the fourth working example.
Figure 22:
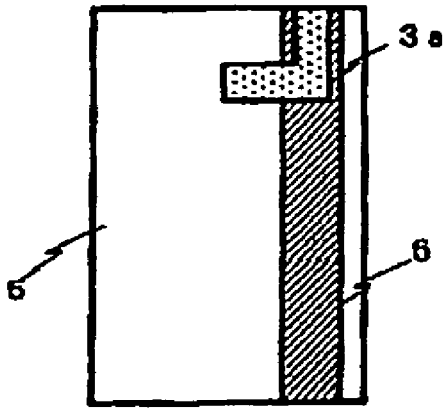
FIG. 22 is a diagram showing the production steps of the inductance device pursuant to the fourth working example of the present invention.
Figure 22:
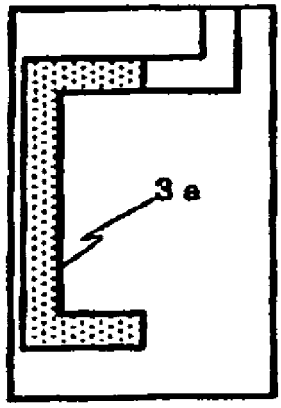
Figure 22:
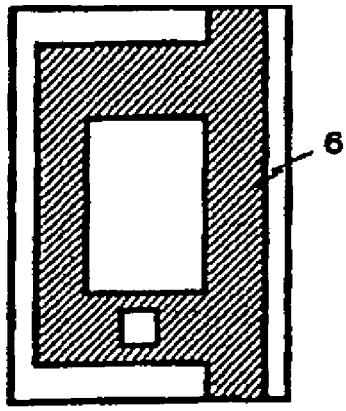
Figure 23:
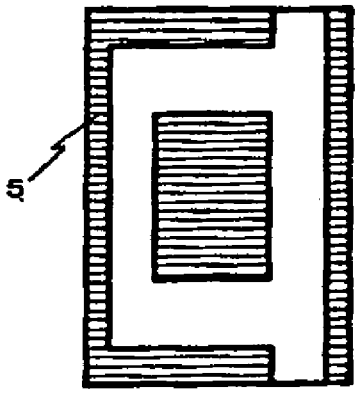
FIG. 23 is a diagram showing the production steps of the inductance device pursuant to the fourth working example of the present invention.
Figure 23:
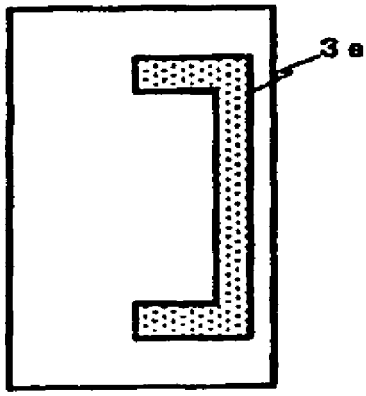
Figure 23:
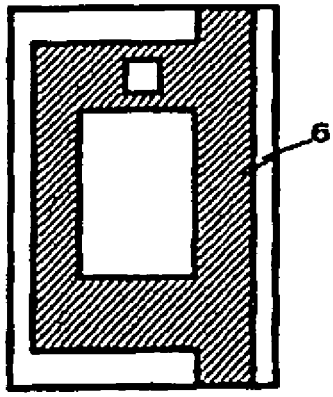
Figure 24:
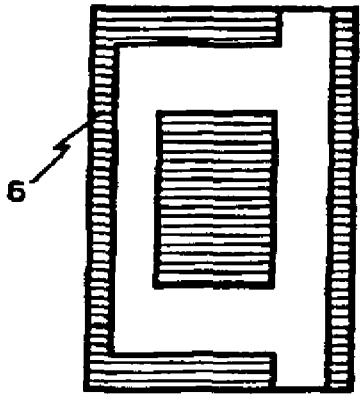
FIG. 24 is a diagram showing the production steps of the inductance device pursuant to the fourth working example of the present invention.
Figure 24:
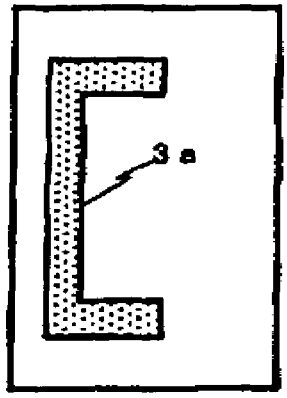
Figure 24:
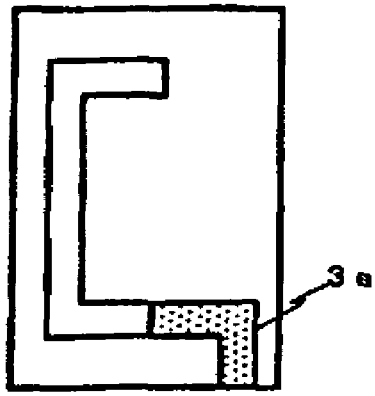
Figure 25:
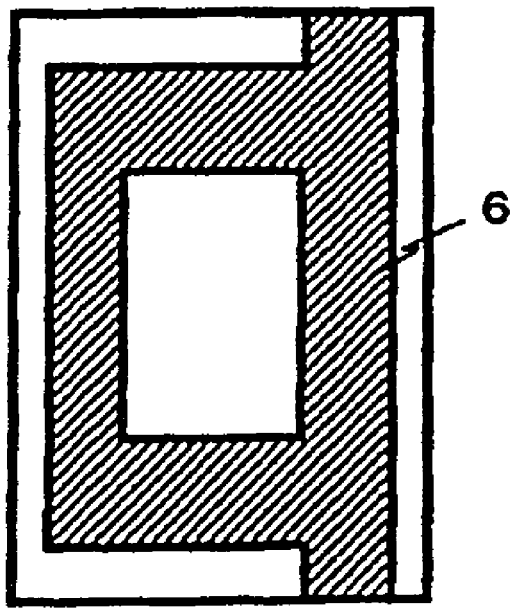
FIG. 25 is a diagram showing the production steps of the inductance device pursuant to the fourth working example of the present invention.
Figure 25:
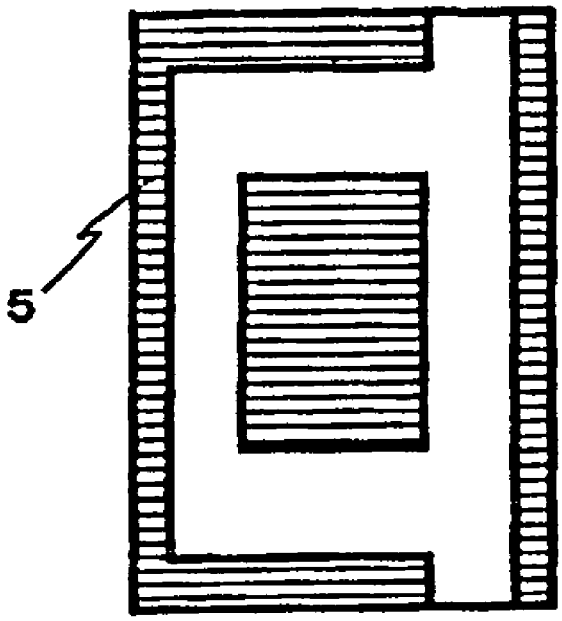

A fourth working example is explained below. FIG. 20 is an A-A profile of inductance device 1 in this working example while FIG. 21 is a B-B profile. In the third working example, the conductor comprising coil 3 with an exposed side is formed, and insulating resin 4 is applied to this exposed section, but in this working example, nonmagnetic material 6 is disposed on the section covered by aforementioned insulating resin 4, and the top, bottom and outside of n winding section 31 are surrounded by nonmagnetic material 6 so as to form a magnetic gap that blocks the magnetic flux from forming so as to surround n winding section 31.

This inductance device 1A is constructed through the procedures shown in FIGS. 22 to 25. The construction procedures of this inductance device 1A are basically identical with the procedures explained in FIGS. 16 to 19. However, the difference is that nonmagnetic material 6 is disposed at the section covered by insulating resin 4 in aforementioned third working example. The section upon which is mounted nonmagnetic material 6 as explained above acts as a magnetic gap in this fourth working example as well, and a magnetic flux is not formed so as to surround n winding section 31, as shown in FIG. 21. On the other hand, magnetic flux ( ) is formed so as to surround n+1 winding section 32 (FIG. 21). This is because a magnetic gap that blocks magnetic flux Φ is not mounted in the magnetic circuit of magnetic flux Φ.

WORKING EXAMPLE 5

Figure 28:
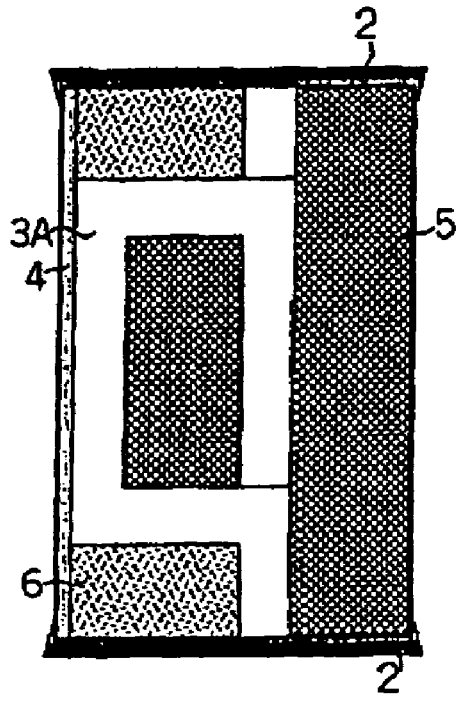
FIG. 28 is an A-A profile of the inductance device in FIG. 1 in the fifth working example.
Figure 29:
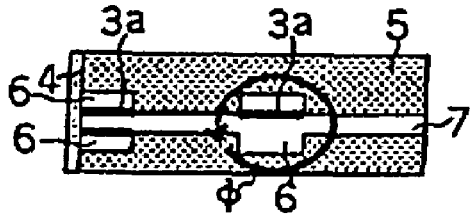
FIG. 29 is a B-B profile of the inductance device in FIG. 1 in the fifth working example.

Coil 3A shown in FIG. 13 is used in the inductance device 1A (FIG. 1) in a fifth working example. FIG. 28 is an A-A profile of inductance device 1A (FIG. 1) in the fifth working example while FIG. 29 is a B-B profile. The conductor comprising coil 3A with an exposed side is formed on the side of inductance device 1A in n+1 winding section 32 of coil 3A, and insulating resin 4 is applied to this exposed section.

The ring center in coil 3A and the exterior of n winding section 31 are formed from magnetic material 5 which is magnetic circuit material. Nonmagnetic material 6 is mounted so that conductor pattern 3*a* of the coil is interposed. In particular, nonmagnetic material 6 is mounted above and below n+1 winding section 32 so as to be thicker than the separation between conductor patterns 3*a*, 3*a* in n winding section 31.

Second magnetic gap 7 comprising nonmagnetic material that is narrower (thinner) than nonmagnetic material 6 that is mounted above and below n winding section 31 is mounted between the bottom-most conductor pattern 3*a* in n+1 winding section 32 and conductor pattern 3*a* thereabove, viewed from the bottom of conductor pattern 3*a* of n winding section 31.

Inductance device 1A is constructed through the same procedures as those shown in FIGS. 16 to 19. Since the side of the conductor comprising coil 3A (side of n+1 winding section 32) is exposed in such a multilayered state, insulating resin 4 is applied to this exposed section. As noted above, nonmagnetic material 6 is mounted above and below n+1 winding section 32 so as to be thicker than the separation between conductor patterns 3*a*, 3*a*, and the conductor comprising coil 3 with an exposed side has insulating resin 4 applied to this exposed section that acts as a magnetic gap in the inductance device having aforementioned structure, and as clarified in FIG. 29, no magnetic flux is created so as to surround n+1 winding section 32. In short, a magnetic gap is mounted that blocks a magnetic flux from surrounding n+1 winding section 32. On the other hand, magnetic flux Φ is formed so as to surround n winding section 31 (FIG. 29). This is because a magnetic gap that blocks magnetic flux Φ is not mounted in the magnetic circuit of magnetic flux Φ. This working example as well is able to produce the same effects as those in each of aforementioned working examples.

WORKING EXAMPLE 6

Figure 30:
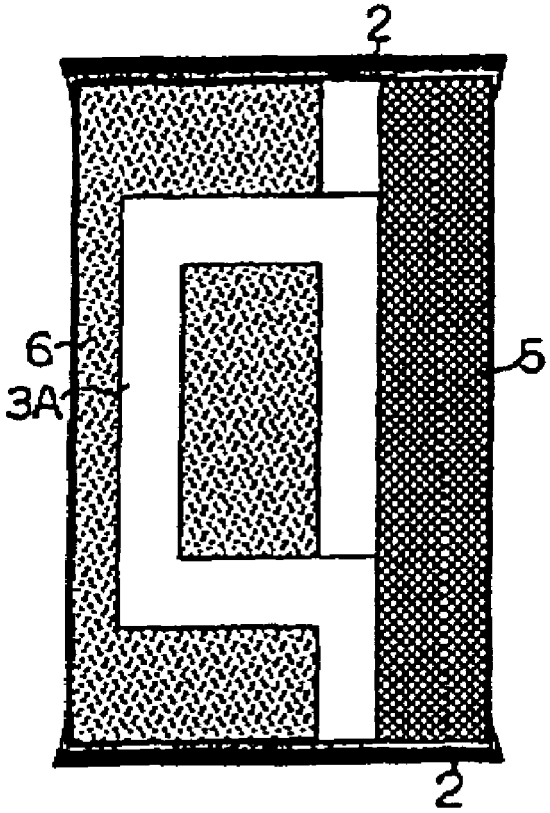
FIG. 30 is an A-A profile of the inductance device in FIG. 1 in the sixth working example.
Figure 31:
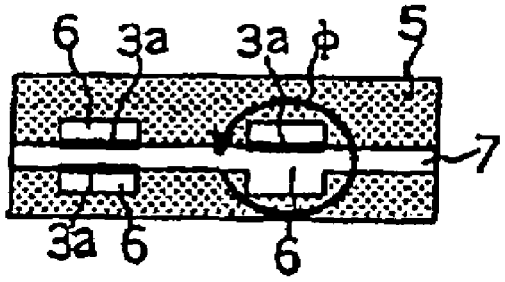
FIG. 31 is a B-B profile of the inductance device in FIG. 1 in the sixth working example.

A sixth working example is explained below. FIG. 30 is an A-A profile of inductance device 1A in this working example while FIG. 31 is a B-B profile. In the fifth working example, the conductor comprising coil 3A with an exposed side is formed, and insulating resin 4 is applied to this exposed section, but in this working example, nonmagnetic material 6 is disposed on the section covered by aforementioned insulating resin 4, and the top, bottom and outside of n+1 winding section 32 are surrounded by nonmagnetic material 6 so as to form a magnetic gap that blocks the magnetic flux from forming so as to surround n+1 winding section 32.

This inductance device 1A is constructed through the procedures shown in FIGS. 22 to 25. The construction procedures of this inductance device 1A are basically identical with the procedures explained in FIGS. 16 to 19. However, the difference is that nonmagnetic material 6 is disposed at the section covered by insulating resin 4 in aforementioned fifth working example. The section upon which is mounted nonmagnetic material 6 as explained above acts as a magnetic gap in this sixth working example as well, and a magnetic flux is not formed so as to surround n+1 winding section 32, as shown in FIG. 31. On the other hand, magnetic flux d is formed so as to surround n winding section 31 (FIG. 31). This is because a magnetic gap that blocks magnetic flux Φ is not mounted in the magnetic circuit of magnetic flux Φ.

The difference in effect between an inductance device pursuant to one of the working examples (having a gap at either n winding section 31 or n+1 winding section 32) and a conventional inductance device (product provided with n winding section and n+1 winding section in which the magnetic flux balance is poor) decreases when the number of turns (number of windings) in a multilayered coil is high. Table 1 below shows the measurements of (current in a conventional device/current in a device pursuant to the present invention) when the inductance value has fallen by 20% in an inductance device having the structure pursuant to the present invention and an inductance device with a conventional structure. Table 1 clearly shows that the effects are pronounced when the value of n is not more than 4 in n winding section 31 and n+1 winding section 32 of the product pursuant to the present invention, while the difference from the effect of a conventional device diminishes when it is 5 or more.

TABLE 1

| Number of windings | 2 | 3 | 4 | 5 | 6 |
|---|---|---|---|---|---|
| Current ratio | 83.3 | 84.0 | 88.0 | 96.7 | 98.0 |

WORKING EXAMPLE 7

Figure 32:
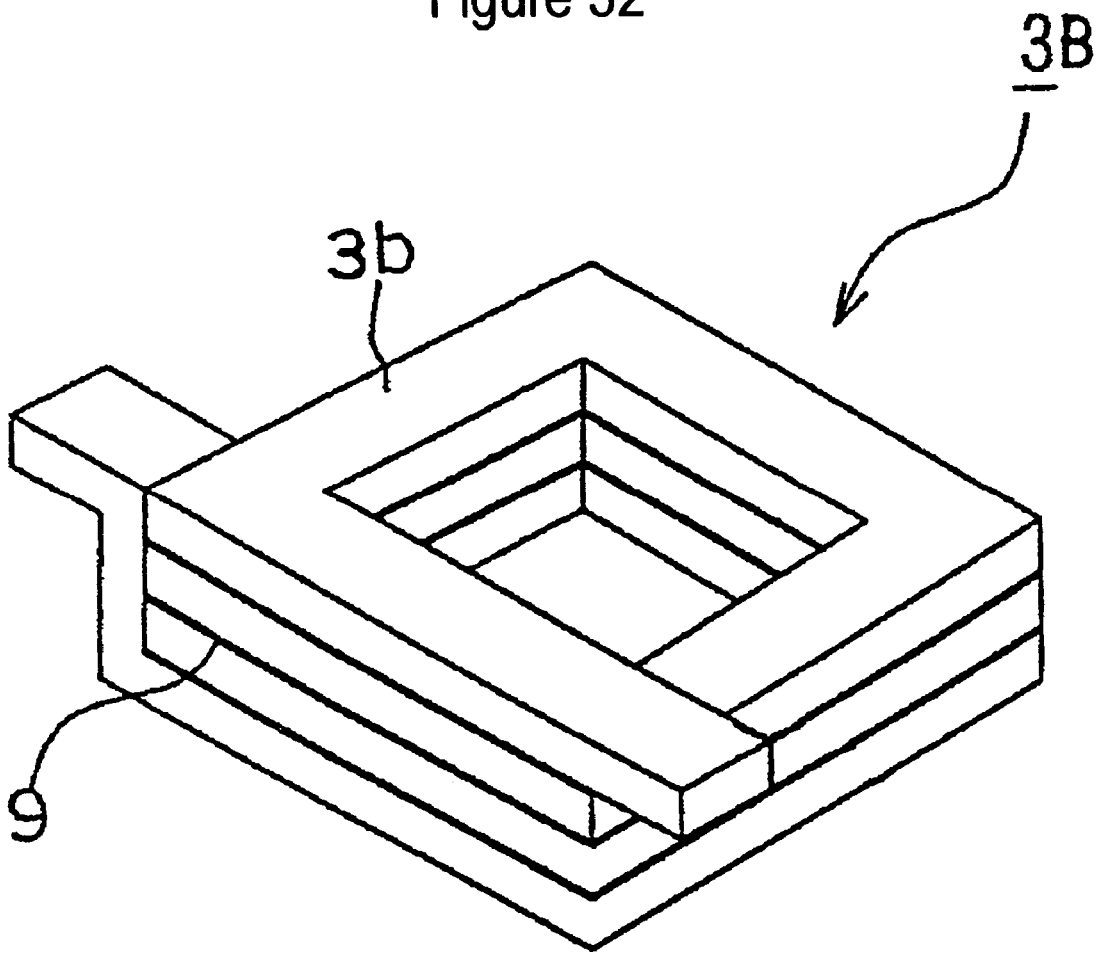
FIG. 32 is an oblique view showing one example of a coil used in the seventh working example of the present invention.
Figure 33:
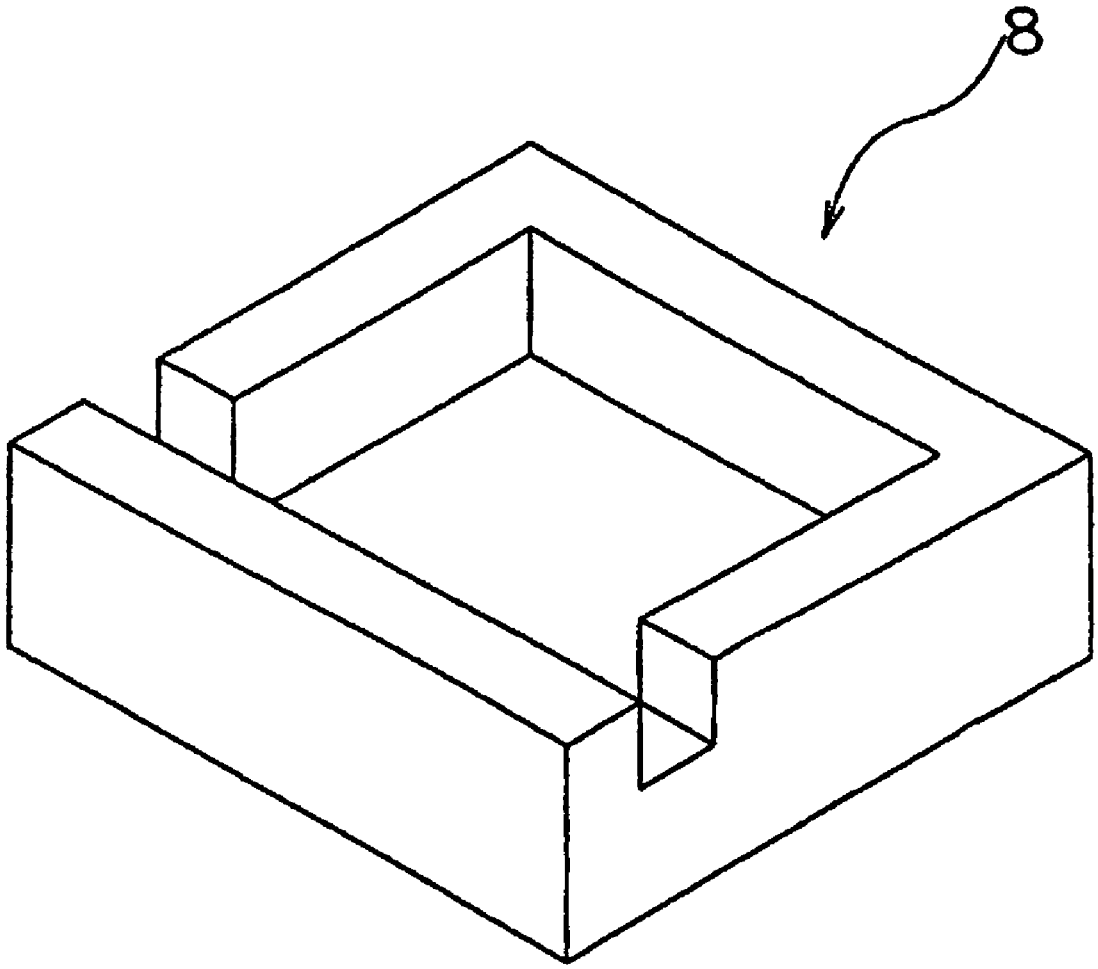
FIG. 33 is an oblique view showing one example of the case used when constructing an inductance device pursuant to the seventh working example using the coil shown in FIG. 32.

A multilayered inductance device was presented in aforementioned explanation, but a flat-square wound coil 3B with a hollow core winding may be constructed as shown in FIG. 32, and the sides may be constructed with the structure shown in each of aforementioned working examples. For example, a magnetic gap (first magnetic gap) that blocks either the magnetic flux formed so as surround the n winding section or the magnetic flux formed so as to surround the n+1 winding section can be mounted by packing the same paste of nonmagnetic material 6 as that used in a multilayered device into and around gap 9 of conductor winding 3*b* that constitutes coil 3B in case 8 shown in FIG. 33, and by then packing paste constituting the magnetic layer comprising magnetic material 5 in the remaining sections. In addition, the exposed sides may be coated with insulating resin 4. The application to a flat-square wound coil 3B of the structure explained with regard to a multilayered device is the important point.

In addition, a second magnetic gap that is narrower (thinner) than the first magnetic gap that blocks aforementioned magnetic flux in a direction orthogonal to the axial direction of the ring that constitutes coil 3B can be formed by packing paste of nonmagnetic material 6 in gap 9 of conductor winding 3*b* that constitutes coil 3B.

The same effects as those of a multilayered coil type of inductance device can be obtained by an inductance device using a flat-square wound coil 3B. The mounting of a second magnetic gap is not essential in either aforementioned working examples or variants (whether multilayered type or flat-square wound coil type of inductance device).

The invention claimed is:

1. A multilayered-type inductance device comprising:

a ring-shaped coil having an n winding section in which the number of windings is n, and an n+1 winding section in which the number of windings is one more than in the n winding section, a soft magnetic ceramic member embedding the ring-shaped coil, the soft magnetic ceramic member and the ring-shaped coil being layered into the device, wherein the soft magnetic ceramic member is mounted to at least partially surround the ring-shaped coil, an area of the n winding section or of the n+1 winding section is exposed outside of the soft magnetic ceramic member, and the soft magnetic ceramic member is a magnetic circuit material to form a magnetic circuit for passing a magnetic flux, said device having a magnetic gap between the soft magnetic ceramic member and only one of the n winding section or the n+1 winding section, to block either a portion of the magnetic flux formed around the n winding section or a portion of the magnetic flux formed around the n+1 winding section.

2. The multilayered-type inductance device of claim 1, wherein the magnetic gap is a first magnetic gap, and wherein the device further has a second magnetic gap that is narrower than the first magnetic gap to block the magnetic flux in a direction orthogonal to the axial direction of the ring-shaped coil.

3. The multilayered-type inductance device of claim 1, wherein the magnetic gap comprises nonmagnetic ceramic.

4. The multilayered-type inductance device of claim 1, wherein the exposed area is coated with an insulating resin.

5. The multilayered-type inductance device of claim 1, wherein n is less than or equal to 4.

6. The inductance device of claim 2, wherein n is less than or equal to 4.

7. The multilayered-type inductance device of claim 2, wherein the first and second magnetic gaps comprise nonmagnetic ceramic.

8. The multilayered-type inductance device of claim 2, wherein an area of the n winding section or of the n+1 winding section is exposed outside of the soft magnetic ceramic member.

9. The multilayered-type inductance device of claim 8, wherein the exposed area is coated with an insulating resin.

* * * * *